US009444209B2

(12) United States Patent
Schroeder et al.

(10) Patent No.: US 9,444,209 B2
(45) Date of Patent: Sep. 13, 2016

(54) BRUSH DEVICE, ELECTRIC MACHINE

(71) Applicant: Robert Bosch GmbH, Stuttgart (DE)

(72) Inventors: Bernd Schroeder, Esslingen (DE); Yves Detrois, Magstadt (DE); Carnelia Mauer, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 236 days.

(21) Appl. No.: 13/955,820

(22) Filed: Jul. 31, 2013

(65) Prior Publication Data

US 2014/0035399 A1 Feb. 6, 2014

(30) Foreign Application Priority Data

Aug. 2, 2012 (DE) ..... 10 2012 213 700

(51) Int. Cl.

| | |
|---|---|
| ***H01R 39/36*** | (2006.01) |
| ***H01R 39/38*** | (2006.01) |
| ***H01R 39/39*** | (2006.01) |
| ***H01R 39/41*** | (2006.01) |

(52) U.S. Cl.

CPC ..... *H01R 39/383* (2013.01); *H01R 39/36* (2013.01); *H01R 39/38* (2013.01); *H01R 39/39* (2013.01); *H01R 39/41* (2013.01)

(58) Field of Classification Search

CPC ..... H02K 5/14; H02K 5/145; H01R 39/38–39/646

USPC ..... 310/239, 242, 229, 240, 244, 245, 248, 310/249

See application file for complete search history.

(56) References Cited

U.S. PATENT DOCUMENTS

| | | | | |
|---|---|---|---|---|
| 3,745,393 | A * | 7/1973 | Spors | 310/239 |
| 3,849,684 | A * | 11/1974 | Duncan et al. | 310/242 |
| 3,967,148 | A * | 6/1976 | Walsh | 310/239 |
| 4,613,781 | A * | 9/1986 | Sanders | 310/239 |
| 4,959,576 | A * | 9/1990 | Horibe et al. | 310/239 |
| 6,617,745 | B1 | 9/2003 | Reinartz et al. | |
| 6,750,585 | B2 | 6/2004 | You | |
| 7,095,243 | B1 * | 8/2006 | Davis | 324/765.01 |
| 2003/0230952 | A1 | 12/2003 | Inoue et al. | |
| 2007/0080602 | A1 | 4/2007 | Yoshimura | |
| 2013/0140940 | A1 * | 6/2013 | Schroeder | H02K 13/003 310/232 |

FOREIGN PATENT DOCUMENTS

DE EP 1311039 A2 * 5/2003 ..... H01R 39/383

OTHER PUBLICATIONS

Sezgin Acar, Electrical Machine with Brush Holder, Bosch GMBH Robert, May 14, 2003, EP1311039.*

* cited by examiner

*Primary Examiner* — Terrance Kenerly
*Assistant Examiner* — Alexander Singh
(74) *Attorney, Agent, or Firm* — Michael Best & Friedrich LLP

(57) ABSTRACT

The invention relates to a brush device, in particular for an electric machine, comprising at least one brush holder which has at least two brush boxes for receiving in each case one brush, wherein the brushes are mounted in a displaceable manner in the respective brush box and wherein a helical spring can be braced/is pretensioned in each case between one of the brushes and a stop in the respective brush box, and comprising at least two elastically deformable electrical conductors which are each connected with an end thereof to one of the brushes.

1 Claim, 2 Drawing Sheets

BRUSH DEVICE, ELECTRIC MACHINE

BACKGROUND OF THE INVENTION

The invention relates to a brush device, in particular for an electric machine, comprising at least one brush holder which has at least two brush boxes for receiving respectively one brush, wherein the brushes are mounted in the respective brush box in a displaceable manner and wherein respectively one helical spring can be braced/is pretensioned in the respective brush box between one of the brushes and a stop, and comprising at least two elastically deformable electrical conductors which are connected in each case with an end thereof to one of the brushes.

In addition, the invention relates to an electric machine comprising a brush device.

Brush devices as well as electric machines of the type mentioned above are known from the prior art. Slip ring devices or commutator devices are often provided in electric machines which serve to reverse the current fed through the coils of the electric machine. These commutator devices comprise as a rule at least two brushes which are pressed by one or a plurality of brush holders against commutator segments arranged on a rotatable shaft. In order to ensure a reliable contact between brushes and commutator segments, the brushes are often impinged with a spring force and thereby pressed against the commutator segments. Brush devices are thus, for example, known, in which helical springs are provided in the brush holder, which can be braced between the brushes and a stop formed by the end of the respective brush box.

U.S. patent application US 20070080602 thus discloses a brush device, in which two brushes are mounted in a displaceable manner in respectively one brush box in a brush holder, wherein respectively one helical spring is provided between the respective brushes and the end of the corresponding brush box. In so doing, an elastically deformable electrical conductor is provided for each of the brushes in order to electrically contact said brushes. Each electrical conductor is thereby laterally attached to one of the brushes and is routed into a space between the brush boxes and from there to a connection, which, for example, is formed by a strip conductor. The electrical conductor is thus connected laterally to the respective brush because it is not possible to route said conductor on the back side of the respective brush facing the helical spring. The lateral connection of the conductor of the respective brush is however relatively expensive to manufacture.

SUMMARY OF THE INVENTION

The brush device according to the invention has the advantage that the respective electrical conductor is connected to a back side of the brushes which leads to cost advantages and nevertheless does not present the risk of hindering the function of the helical spring or of becoming seized in the same when said helical spring is pressed together, which would result in said conductor being bent at least in certain sections. According to the invention, provision is therefore made for the respective stop, at least in certain regions, to be of annular, in particular circular ring-shaped, design comprising a through opening and for the respective electrical conductor from the respective brush to be routed through the respective helical spring and the through opening of the stop supporting the respective helical spring to a connection at the end of the respective brush box, wherein a lateral deflection space for the electrical conductor is configured in the brush holder between the connection and the stop. The brush holder therefore also further comprises spring-loaded brushes in each of the brush boxes. Each brush box is however divided into two sections. As before, the brush, which is mounted in the brush box so as to be displaceable in one direction, is located in the front section. The helical spring, which presses the brush to the front, is furthermore located in the front section. The front section is separated from the rear section by the stop of the respective brush box, which stop is configured annularly at least in regions. A helical spring is now not present in the rear section. Instead a lateral deflection space for the electrical conductor is configured in each case in the rear section of the brush box. The electrical conductor can deflect into said deflection space when the respective brush is being displaced by elastic deformation without the function of the helical spring being impaired. A lateral connection of the electrical conductor on the respective brush can thus be eliminated.

The respective electrical conductor is preferably connected with one end thereof to a back side of the respective brush facing away from a brush contact surface of the respective brush. Provision is particularly made for the electrical conductor to be connected in a positive locking and force fitting manner, particularly by means of stamping, to the brush on the back side thereof; thus ensuring a reliable connection.

Provision is made according to an advantageous modification to the invention for the respective stop of the brush box to be embodied as a cross-sectional tapering of the respective brush box. During the manufacture of the brush holder, the stop for the helical spring can thereby be provided in a simple manner at a desired location in the brush box. Particularly if the brush holder is manufactured from plastic, the position of the stop can be easily determined. As a result of the cross-sectional tapering, the through opening further automatically remains, through which the electrical conductor is routed into the section of the brush box lying at the back.

A separate lateral deflection space is preferably associated with each brush box. In so doing, the brush holder comprises two deflection spaces for two brushes, in which spaces an electrical conductor can in each case deflect when the brushes are displaced under elastic deformation.

According to an advantageous modification to the invention, provision is made for the cross section of the deflection spaces to be configured L-shaped in each case. As viewed in cross section, the deflection spaces are preferably not arranged in a centered manner but have a limb which extends laterally away from the brushes in an off-centered manner. The electrical conductor can accordingly deflect into this limb.

In a particularly preferred manner, the deflection spaces—as viewed in cross section—engage in one another. The L-shaped deflection spaces preferably are arranged relative to one another in two axes in mirror image or in a point-symmetrical manner to an imaginary center of the brush holder. Due to the L-shape, the deflection spaces can be combined with each other such that the available space in the brush holder is optimally used and a sufficient width is provided for each deflection space. The width thereby determines the maximum deflection of the respective electrical conductor. The height—as viewed in cross section—of the deflection space must thereby not be configured much larger than the width of the electrical conductor in order to prevent said electrical conductor from jamming in the deflection space.

Provision is made according to an advantageous modification to the invention for the connection of the brush holder, to which the other end of the respective electrical conductor is connected, to be welded, configured as a strip conductor or to be formed from a strip conductor. Via the strip conductor, the respective brush can then be electrically contacted from the outside in a simple manner. Provision can, for example, be made for the strip conductor to merge into a plug contact which is accessible from the outside.

In a particularly preferable manner, provision is made for the two deflection spaces—as viewed in cross section—to be separated from one another by a substantially S-shaped separating wall of the brush holder. On account of the S-shape of the separating wall, the L-shape of the oppositely lying deflection spaces is automatically formed, wherein the separating wall obtains soft edges or rather the L-shape is provided with radii as a result of the S-shape, said radii simplifying the manufacture of the brush holder and allowing the same to have a high load carrying capacity.

According to a preferred embodiment of the invention, provision is made for the brush holder to be embodied as a plastic injection molding part. The position of the stop in the respective brush box can thereby be easily defined or determined by mold cores/sliders differing in size or in the distance inserted. In so doing, the brush holder can be adapted to different requirements in a simple and cost effective manner.

The electric machine according to the invention is characterized by a brush device as it is described above. The electric machine therefore has likewise the advantages stated above.

BRIEF DESCRIPTION OF THE DRAWINGS

The invention is explained below in detail with the aid of the drawings. In the drawings.

DETAILED DESCRIPTION

Figure 1:
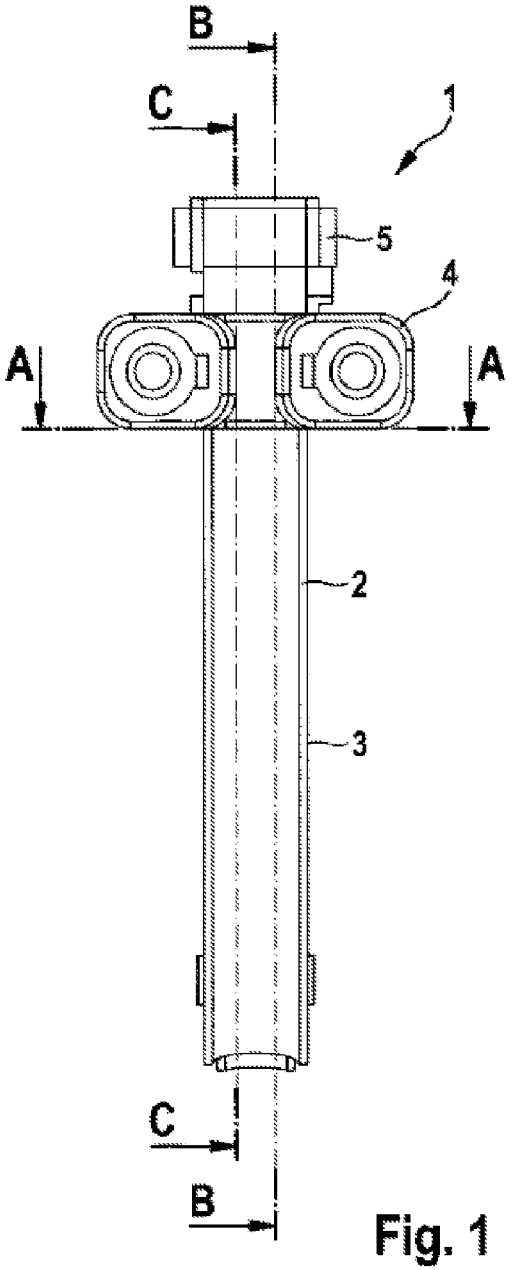
FIG. 1 shows a brush device in a side view.

FIG. 1 shows—in a simplified representation—a side view of a brush device 1 for an electric machine, which is not depicted here in detail, of in particular a motor vehicle. The brush device 1 can thereby, for example, be a constituent part of a commutator or a slip ring system of the electric machine. The brush device 1 comprises a brush holder 2, which is manufactured from plastic. In particular, the brush holder 2 is manufactured by means of a plastic injection molding process. Said brush holder 2 is configured in a housing-like fashion and has a holder section 3, a contacting section 4 as well as a connection section 5. More detailed information is provided in the present description with regard to FIGS. 2 to 4 which show cross-sectional representations of the brush device 1.

Figure 2:
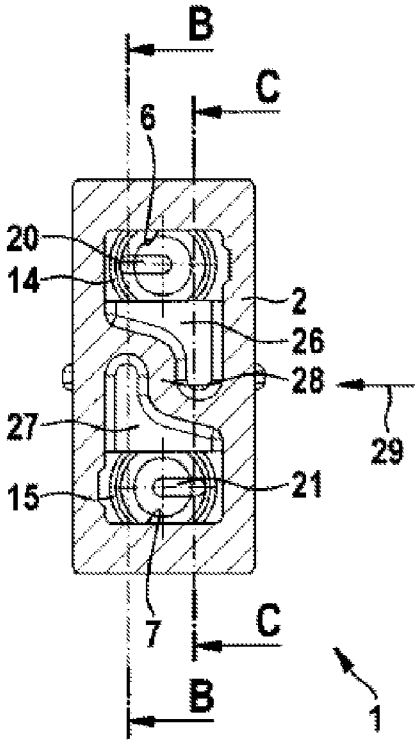
FIG. 2 shows the brush device in a cross-sectional representation.

FIG. 2 thus shows a cross-sectional depiction of the brush device 1 along the line A-A from FIG. 1. The brush holder 2 comprises two brush boxes 6 and 7 which extend parallel to one another along the holder section 3 in the brush holder 2.

Figure 3:
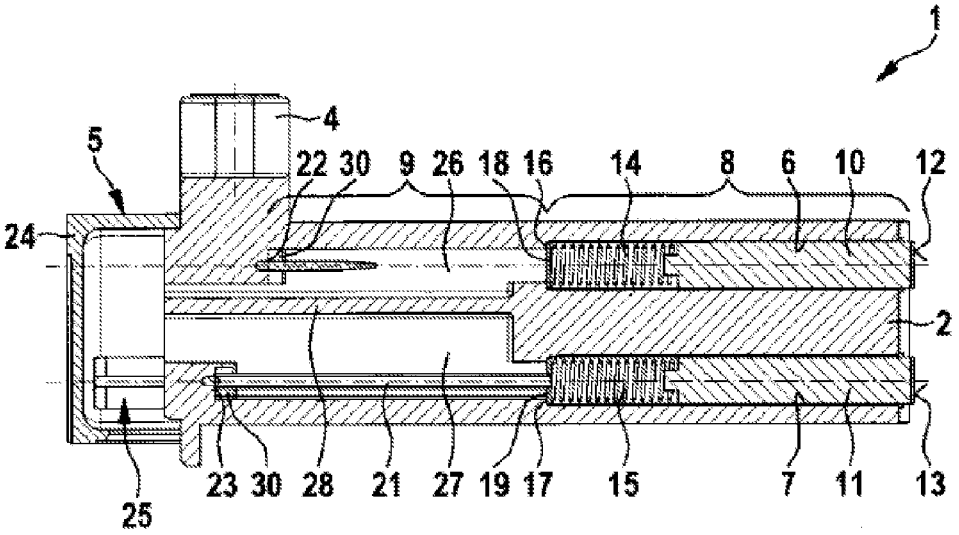
FIG. 3 shows the brush device in a first longitudinal representation.
Figure 4:
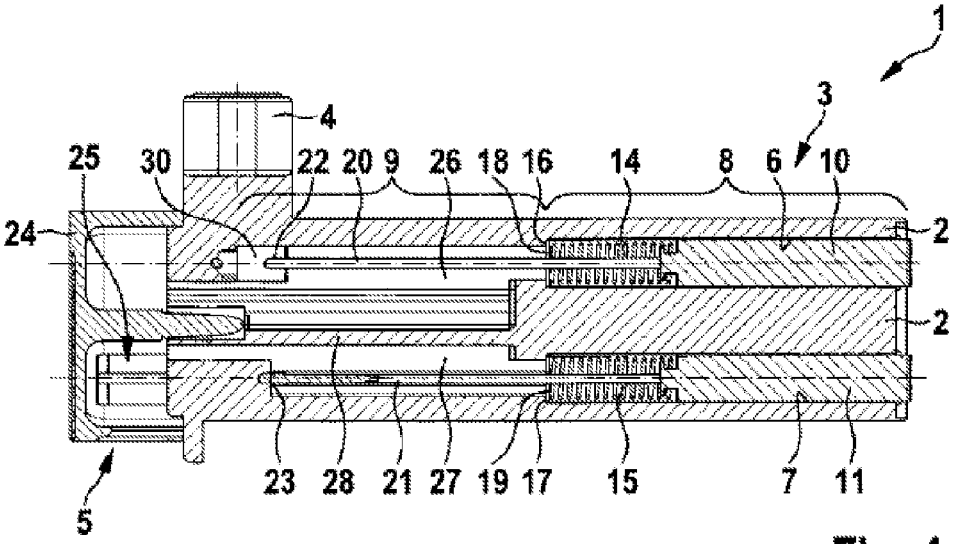
FIG. 4 shows the brush device in a second longitudinal representation.

FIGS. 3 and 4 show respectively a longitudinal depiction of the brush device 1 along the lines B-B (FIG. 3) and C-C (FIG. 4) which are plotted in FIG. 2. As can particularly be seen in FIGS. 3 and 4, the brush boxes 6 and 7 are in each case divided up into a front section 8 and a rear section 9.

A brush 10 or 11 is in each case mounted in a displaceable manner in each of the front sections 8 of the brush boxes 6 and 7 such that an exposed (brush) contact surface 12, 13 of the brushes 10 and 11 protrudes beyond the brush holder 2 in order, for example, to contact commutator segments on a rotor shaft. The back side of the brushes 10 and 11 facing the contact surfaces 12 interacts in each case with a helical spring 14 or 15, which both are embodied as compressive springs and can be braced between the back side of the brushes 10 and 11 and a stop 16 or 17 of the respective brush box 6.

The stops 16 and 17 are formed respectively by a cross-sectional tapering of the brush boxes 6 and 7 so that the front section 8 of the respective brush box 6, 7 has a larger cross section than the section 9 located behind it. The stops 16 and 17 are preferably configured annularly; thus enabling the respective helical spring 14, 15 to be evenly supported. By virtue of the stops 16, 17 being annularly configured, a through opening 18 or 19 remains, which leads from the front section to the rear section 9. In the present embodiment and in a preferable manner, the length of the rear section 9 corresponds in each case substantially to the length of the front section 8. The ring shape of the stops 16, 17 can thereby be of annular, oval, rectangular or even square configuration. It is particularly not absolutely necessary for the ring shape to correspond to the cross section of the helical springs 14, 15. In order to facilitate a large through opening 18, 19, provision is preferably made for the respective helical spring 14, 15 to abut only in regions on the respective stop 16, 17. In other words, the region of the stop interacting with the helical springs can be smaller than the region that entirely forms the through opening.

Electrical conductors 20, 21, which are elastically deformable and are embodied in the present exemplary embodiment as so-called litz (braided) wires, are provided to electrically contact the brushes 10, 11. The electrical conductors 20, 21 are respectively connected to the back side of one of the brushes 10, 11.

The stranded wires or, respectively, the electrical conductors 20, 21 are attached in sections to the (carbon) brushes 10, 11 by stamping. The electrical conductors 20, 21 are routed from the back side of the brushes 10, 11 to a respective connection bore 22, 23 which is configured at the end of the respective brush box 6, 7 so as to face the brushes 10, 11. In order to simplify mounting, at least one bevel 30 is provided in the brush boxes 6, 7, which guides the respective electrical conductor from the brush box 6, 7 into a connection bore located behind said box. The bevels 30 therefore serve as insertion bevels for the electrical conductors 20, 21. In a particularly preferred manner, funnel-shaped bevels 30 are provided in the respective brush box 6, 7 in order to ensure that the electrical conductor 20, 21 is reliably threaded into the respective connection bore. A busbar for electrically contacting the electrical conductors 20, 21 projects in each case into the connection bores 22, 23. According to the present exemplary embodiment, the busbars lead out of the brush holder 2 into the connection section 5, where said busbars are preferably welded to the electrical conductors 20, 21. In addition, the busbars preferably lead into the contacting section 4, where they can be electrically contacted from the outside.

As depicted in FIGS. 3 and 4, the free end of the brush holder 2 is covered by a protective cap 24 in the connection section 5, said cap protecting the strip conductors or, respectively, busbars, which are indicated by way of example, as well as the welded joints 25.

A deflection space 26, 27 is in each case laterally associated with each of the brush boxes 6 and 7 in the rear section 9. As can be best extracted from FIG. 2, the deflection spaces 26, 27 have an L-shaped cross section, wherein said deflection spaces are separated from one another by an S-shaped separating wall 28 of the brush holder 2. The deflection spaces 26, 27 are thereby arranged or aligned with respect to one another such that the limb that extends laterally from the respective brush box 6, 7 extends to the oppositely located brush box 7, 6, whereby the deflection spaces 26, 27 engage in one another or in a lateral view according to arrow 29 are arranged so as to overlap.

During operation, when the brushes 10, 11 are pressed by means of the brush holder 2 against the commutator segments of a rotating rotor shaft, the electrical conductors 20, 21 are elastically deformed when the brushes 10, 11 are being displaced in the direction of the rear section 9. In so doing, said electrical conductors 20, 21 can deflect laterally from the brush boxes 6, 7 in the rear section 9 into the advantageous deflection spaces 26, 27. The advantageous design makes it possible for brushes 10, 11 having braided wires that exit from the rear to be used. By dividing the respective brush box 6, 7 into the two sections 8, 9 thereof having different cross sections, the support surface for the helical springs 14, 15 or, respectively, the respective stop 16, 17 is formed directly by the respective brush box 6, 7. Depending on the brush length used, the stop 16, 17 is situated at different positions, which can be easily determined during the injection molding process by means of different sliders/mold cores. The slider is thereby preferably guided through the spring chamber, i.e. through the section 8 of the respective brush box 6, 7. The lateral deflection space 26, 27 in the rear section 9 makes it possible for the braided wire or rather the electrical conductor 20, 21 not to be deformed within the helical spring 14, 15 when said helical spring 14, 15 is pressed together. Instead of this, the conductor 20, 21 is now deformed outside of the helical springs, namely in the rear section 9 of the respective brush box. On account of the advantageous deflection spaces, the respective conductor 20, 21 can deflect in a relatively large radius. Damage to the conductor 20, 21 due to friction at the spring windings of the helical springs 14, 15 or due to tight bending radii within said helical springs 14, 15 is thereby avoided. The risk of strand fractures to the braided wire is thereby reduced. In the assembled state, in which the helical springs 14, 15 are maximally deformed or, respectively, compressed, the respective electrical conductor 20, 21 has sufficient space to arbitrarily deform in the deflection spaces 26, 27. In order to configure the respective deflection space 26, 27 as large as possible, the invention proceeds as described above and the respective through opening 18, 19 is embodied in sections thereof larger than the respective region of the stops 16, 17 that interacts with the helical springs 14, 15.

The brush device 1 described and depicted can, for example, be used for an electric machine of a hybrid drive within the framework of a boost recuperation system.

What is claimed is:

1. A brush device, comprising at least one brush holder which has at least two brush boxes for receiving in each case one brush, wherein the brushes are mounted in a displaceable manner in the respective brush boxes and wherein a helical spring is pretensioned in each case between one of the brushes and a stop in the respective brush box, and comprising at least two elastically deformable electrical conductors, which are each connected with an end thereof to one of the brushes, wherein the respective stop is configured at least in regions annularly with a through opening and the respective electrical conductor is routed from the respective brush through the respective helical spring and the through opening of the stop supporting said respective helical spring to a connection at an end of the respective brush box, wherein the respective brush and the respective helical spring in each case extend along a common axis, and wherein a lateral deflection space for the electrical conductor is disposed in each case along the common axis, such that the helical spring is disposed between the lateral deflection space and the brush along the common axis, and wherein the entire respective lateral deflection space is disposed within the brush holder along the common axis between the respective connection and the respective stop, wherein a cross section of the deflection spaces is configured L-shaped in each case.

* * * * *